US011267253B2

(12) United States Patent
Tanabe

(10) Patent No.: US 11,267,253 B2
(45) Date of Patent: Mar. 8, 2022

(54) LIQUID DISCHARGE APPARATUS

(71) Applicant: BROTHER KOGYO KABUSHIKI KAISHA, Nagoya (JP)

(72) Inventor: Yuma Tanabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/117,861

(22) Filed: Dec. 10, 2020

(65) Prior Publication Data

US 2021/0178774 A1 Jun. 17, 2021

(30) Foreign Application Priority Data

Dec. 16, 2019 (JP) ..... JP2019-226312

(51) Int. Cl.

| | |
|---|---|
| ***B41J 2/175*** | (2006.01) |
| ***B41J 2/145*** | (2006.01) |
| ***B41J 2/18*** | (2006.01) |
| ***B41J 2/14*** | (2006.01) |

(52) U.S. Cl.

CPC ..... *B41J 2/17596* (2013.01); *B41J 2/145* (2013.01); *B41J 2/18* (2013.01); *B41J 2002/14354* (2013.01)

(58) Field of Classification Search

CPC ..... B41J 2/17596; B41J 29/38; B41J 2/145; B41J 2/175; B41J 2/19; B41J 2/18; B41J 2002/14354

See application file for complete search history.

(56) References Cited

U.S. PATENT DOCUMENTS

| | | | | |
|---|---|---|---|---|
| 8,226,219 | B2 * | 7/2012 | Umeda | B41J 2/17556 347/85 |
| 8,425,017 | B2 * | 4/2013 | Katada | B41J 29/38 347/85 |
| 9,643,424 | B2 * | 5/2017 | Ando | B41J 2/17566 |
| 9,688,076 | B2 * | 6/2017 | Sugahara | B41J 2/17509 |
| 2016/0288499 | A1 | 10/2016 | Sugahara et al. | |
| 2016/0288518 | A1 | 10/2016 | Ando | |
| 2019/0084303 | A1 | 3/2019 | Sugiura | |

FOREIGN PATENT DOCUMENTS

| | | | |
|---|---|---|---|
| JP | 2016-187926 | A | 11/2016 |
| JP | 2016-190431 | A | 11/2016 |
| JP | 2019-55492 | A | 4/2019 |

* cited by examiner

*Primary Examiner* — An H Do

(74) *Attorney, Agent, or Firm* — Scully, Scott, Murphy & Presser, PC

(57) ABSTRACT

A liquid discharge apparatus includes: a liquid discharge head having a nozzle; a storage chamber that stores liquid; a supply channel communicating with the liquid discharge head and an outlet of the storage chamber; a return channel communicating with the liquid discharge head and an inlet of the storage chamber; a first pump that is provided in the supply channel and feeds the liquid stored in the storage chamber to the liquid discharge head; a gas channel connected to the storage chamber; a second pump that is connected to the storage chamber via the gas channel and discharges gas from inside the storage chamber; and a controller. The controller continues driving of the first pump and driving of the second pump in a first period, and stops the driving of the second pump with the driving of the first pump being continued, in a second period after the first period.

17 Claims, 9 Drawing Sheets

LIQUID DISCHARGE APPARATUS

CROSS REFERENCE TO RELATED APPLICATION

The present application claims priority from Japanese Patent Application No. 2019-226312 filed on Dec. 16, 2019, the disclosure of which is incorporated herein by reference in its entirety.

BACKGROUND

Field of the Invention

The present disclosure relates to a liquid discharge apparatus that discharges liquid from nozzles.

Description of the Related Art

There is known a liquid discharge apparatus that circulates liquid in the vicinity of nozzles. Circulating the liquid in the vicinity of nozzles can discharge air bubbles entering the vicinity of nozzles, and inhibits the increase in viscosity of liquid in the vicinity of nozzles.

There is also known a liquid discharge apparatus that circulates ink in a manifold of an ink-jet head. Circulating the ink in the manifold keeps temperature of ink in the ink-jet head fixed, and disperses components of ink settled in the manifold.

SUMMARY

A pump may be disposed in a supply-side channel through which ink to be supplied to the ink-jet head flows. Driving this pump may circulate ink in the ink-jet head. In this configuration, when a return-side channel, through which ink recovered from the ink-jet head flows, has a high channel resistance or a high internal pressure, positive pressure is applied to meniscuses formed in the nozzles, and the meniscuses of ink may be broken and ink may leak from the nozzles. In order to solve this problem, nozzle pressure may be adjusted by providing another pump different from the supply-side pump in the return-side channel to feed or send ink in the ink-jet head to the return-side channel. However, when the driving of the two pumps is controlled at all times for ink circulation, power consumption increases.

An object of the present disclosure is to provide a liquid discharge apparatus capable of reducing power consumption while appropriately maintaining pressure applied to meniscuses during liquid circulation.

According to the first aspect of the present disclosure, there is provided a liquid discharge apparatus, including:

a liquid discharge head having a nozzle;

a storage chamber configured to store liquid;

a supply channel communicating with the liquid discharge head and an outlet of the storage chamber;

a return channel communicating with the liquid discharge head and an inlet of the storage chamber;

a first pump provided in the supply channel and configured to feed the liquid stored in the storage chamber to the liquid discharge head;

a gas channel connected to the storage chamber;

a second pump connected to the storage chamber via the gas channel and configured to discharge gas from inside of the storage chamber; and a controller, wherein the controller is configured to: continue driving of the first pump and driving of the second pump in a first period that starts in a case that the driving of the first pump and the driving of the second pump are started; and stop the driving of the second pump with the driving of the first pump being continued, in a second period after the first period.

According to the second aspect of the present disclosure, there is provided a liquid discharge apparatus, including:

a liquid discharge head having a nozzle;

a storage chamber configured to store liquid;

a supply channel communicating with the liquid discharge head and an outlet of the storage chamber;

a return channel communicating with the liquid discharge head and an inlet of the storage chamber;

a first pump provided in the supply channel and configured to feed the liquid stored in the storage chamber to the liquid discharge head;

a gas channel connected to the storage chamber;

a second pump connected to the storage chamber via the gas channel and configured to discharge gas from inside of the storage chamber; and a controller, wherein the controller is configured to: continue driving of the first pump and driving of the second pump in a first period that starts in a case that the driving of the first pump and the driving of the second pump are started; and in a second period after the first period, drive the second pump with the driving of the first pump being continued, such that an average power consumption of the second pump in the second period is lower than an average power consumption of the second pump in the first period.

In the present disclosure, when liquid circulation is performed, and when the storage chamber has predefined negative pressure owing to the driving of the second pump, then the driving of the second pump is stopped or the second pump is driven at low power consumption. It is thus possible to reduce the power consumption required for driving the second pump while appropriately maintaining pressure applied to meniscuses during the liquid circulation.

DESCRIPTION OF THE EMBODIMENTS

First Embodiment

Figure 1:
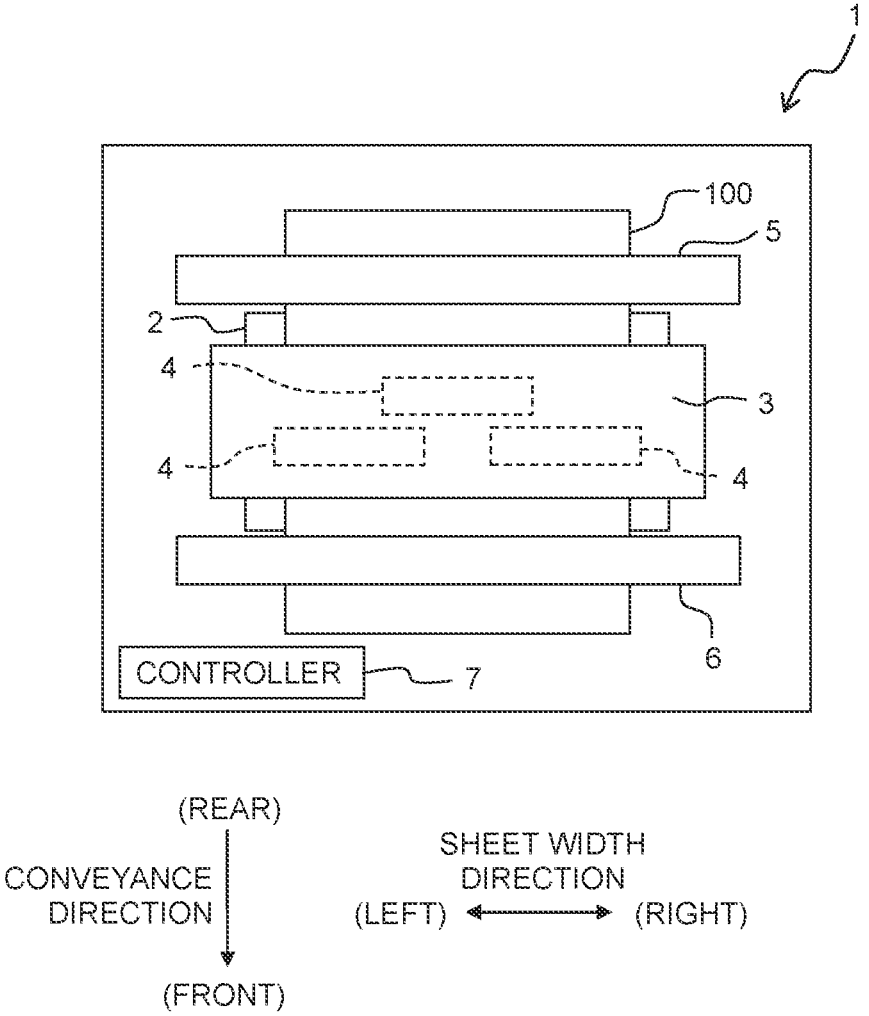
FIG. 1 is a schematic side view of an inner structure of a printer according to the first embodiment of the present disclosure.
Figure 2:
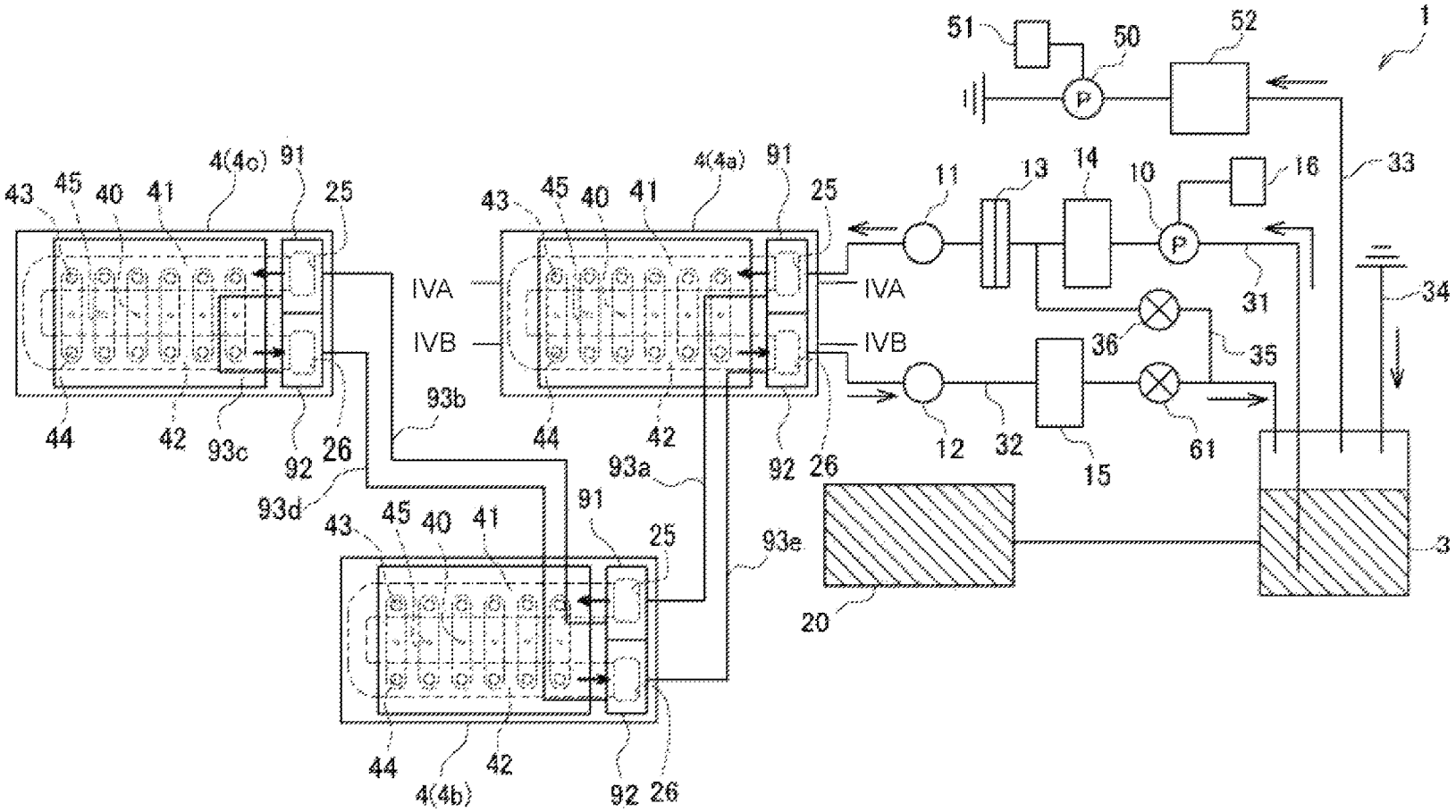
FIG. 2 depicts a channel configuration from a subtank to an ink-jet head according to the first embodiment.
Figure 3:
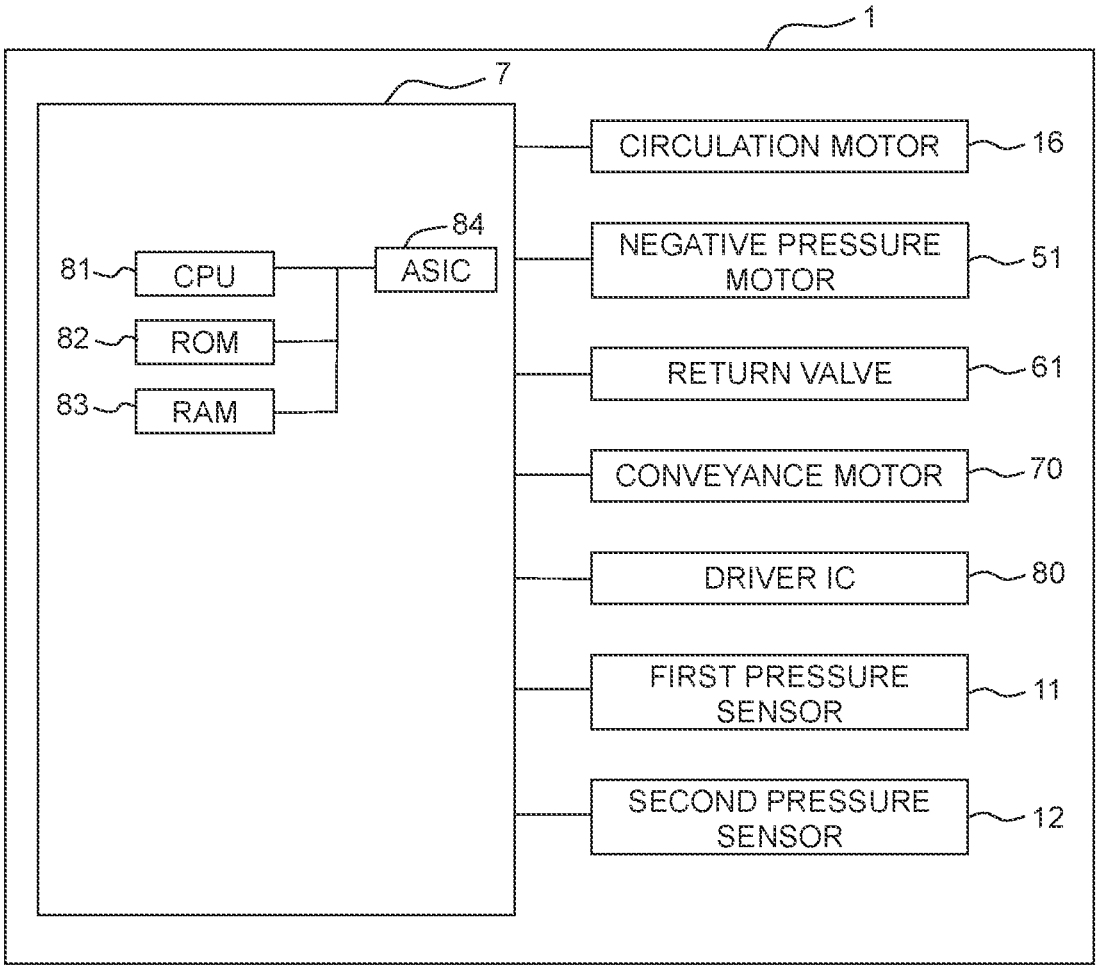
FIG. 3 is a block diagram schematically depicting an electrical configuration of the printer depicted in FIG. 1 and a PC connected to the printer.

Referring to FIGS. 1 to 3, the first embodiment of the present disclosure is described below. A sheet width direction indicated in FIG. 1 is defined as a left-right direction of a printer 1. The right side of FIG. 1 is the right side of the printer 1, and the left side of FIG. 1 is the left side of the printer 1. An upstream side in a conveyance direction of FIG. 1 is defined as a rear side of the printer 1, and a downstream side in the conveyance direction of FIG. 1 is defined as a front side of the printer 1. A direction orthogonal to the sheet width direction and the conveyance direction (a direction orthogonal to a sheet surface of FIG. 1) is defined as an up-down direction of the printer 1. A fore side (front side) of the sheet surface of FIG. 1 is defined as up (upward) of the primer 1, and a far side (the other side) of the sheet surface of FIG. 1 is defined as down (downward) of the printer 1.

<Configuration of Printer>

As depicted in FIG. 1, the printer 1 ("the liquid discharging apparatus" of the present disclosure) is provided with a platen 2, a subtank 3 ("storage chamber" of the present disclosure), three ink-jet heads 4 ("the liquid discharge head" of the present disclosure), two conveying rollers 5, 6, and a controller 7. The ink-jet head 4 is disposed above the platen 2. The subtank 3 is disposed further above the ink-jet head 4. The printer 1 is an ink-jet line head printer that discharges ink to a sheet 100 which is conveyed along a conveyance direction by the two conveying rollers 5, 6.

Platen 2 is a flat plate-shaped member and is disposed between the two conveying rollers 5 and 6 in the conveyance direction. The sheet 100 is placed on an upper surface of the platen 2. As depicted in FIG. 1, the conveying roller 5 is disposed on an upstream side (rear side) in the conveyance direction with respect to the platen 2, the conveying roller 6 is disposed on a downstream side (front side) in the conveyance direction with respect to the platen 2. The two conveying rollers 5, 6 are driven synchronously by the conveying motor 70 (see FIG. 3). The two conveying rollers 5, 6 convey the sheet 100 placed on the upper surface of the platen 2 in the conveyance direction.

As depicted in FIG. 2, the subtank 3 is connected to the ink cartridge 20 and temporarily stores the ink supplied from the ink cartridge 20. The hatched portions in the subtank 3 and the ink cartridge 20 indicate the stored ink. In FIG. 2, one subtank 3 and one ink cartridge 20 are described for simplifying an explanation. Actually, the printer 1 includes four ink cartridges 20 containing four colors of inks (black, yellow, cyan, and magenta), respectively, and four subtanks 3 storing four colors of inks supplied from the four ink cartridges 20, respectively.

Three ink-jet heads 4 are arranged below the subtank 3. When distinguishing the three ink-jet heads 4, each is referred to as a first inkjet head 4 (4*a*), a second ink-jet head 4 (4*b*), and a third ink-jet head 4 (4*c*). When describing the configuration common to the three ink-jet heads 4, it is simply referred to as the ink-jet head 4. As depicted in FIG. 2, the ink-jet head 4 has a supply ink chamber 91, a return ink chamber 92, nozzles 40 arranged in a sheet width direction, a supply common channel 41, a return common channel 42, inflow passages 43, outflow passages 44, and pressure chambers 45.

The ink supply chamber 91 of the first ink-jet head 4 (4*a*) is connected to the subtank 3 via the supply channel 31. The supply channel 31 is a channel through which the ink to be supplied from the subtank 3 to the three ink-jet heads 4 flows by driving the circulation pump 10 described later, and is, for example, a tube or the like. Here, in order to explain the liquid level of the ink stored in the subtank 3 in FIG. 2, the left-right direction of the paper surface is defined as the up-down direction only for the subtank 3, and the left side of the paper surface is defined as above. As depicted in FIG. 2, the leading end of the supply channel 31 connected to the subtank 3 extends into the ink inside the subtank 3. As a result, it is possible to prevent the gas existing inside the subtank 3 from entering the inside of the supply channel 31. The return ink chamber 92 of the first ink-jet head 4 (4*a*) is connected to the subtank 3 via the return channel 32. The return channel 32 is a channel through which the ink returned from the three the ink-jet heads 4 to the subtank 3 flows by driving the circulation pump 10 described later, and is, for example, a tube or the like. The leading end of the return channel 32 connected to the subtank 3 extends to a position above the liquid level of the ink inside the subtank 3. However, the leading end of the return channel 32 may extend into the ink inside the subtank 3. Note that, FIG. 2 depicts connecting relation between the subtank 3 and the three ink-jet heads 4. Although the subtank 3 and the three ink-jet heads 4 do not overlap to make the drawing easier to see, actually the subtank 3 and the three ink-jet heads 4 are arranged so as to overlap one another as depicted in FIG. 1.

Figure 4A:
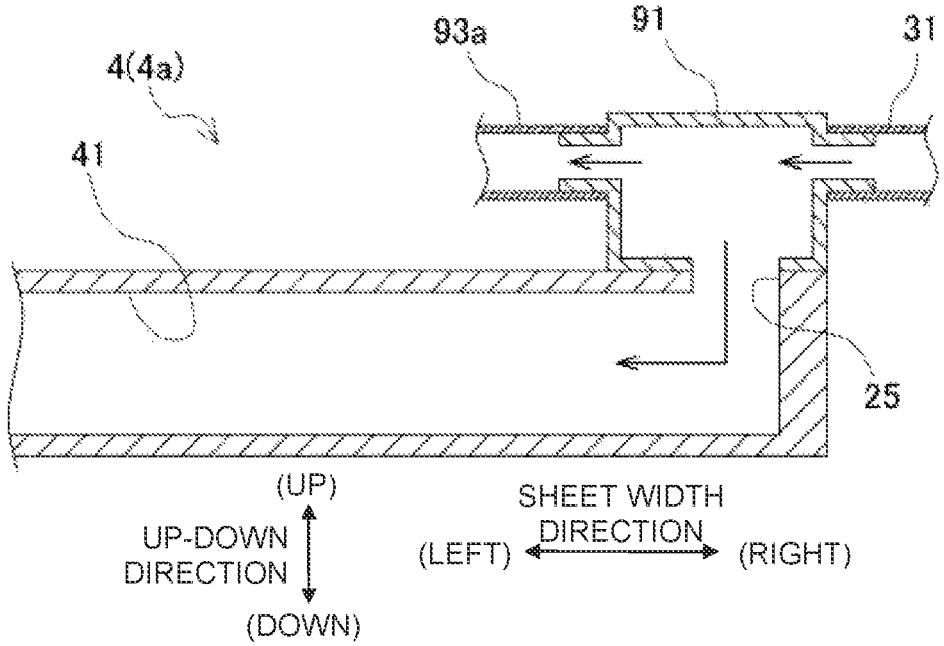
FIG. 4A is a cross-sectional view taken along a line IVA-IVA in FIG. 2.

As depicted in FIG. 4A, the supply channel 31 is connected to an upper right portion of the supply ink chamber 91 of the first ink-jet head 4 (4*a*). The first connecting channel 93*a* is connected to an upper left portion of the supply ink chamber 91. The supply ink chamber 91 of the first ink-jet head 4 (4*a*) is connected to the supply ink chamber 91 of the second the ink-jet head 4 (4*b*) via the first connecting channel 93*a*. The supply ink chamber 91 of the second ink-jet head 4 (4*b*) is connected to the supply ink chamber 91 of the third ink-jet head 4 (4*c*) via the second connecting channel 93*b*. That is, ink supplied from the subtank 3 through the supply channel 31 flows in the order of the supply ink chamber 91 of the first ink-jet head 4 (4*a*), the first connecting channel 93*a*, the supply ink chamber 91 of the second ink-jet head 4 (4*b*), the second connecting channel 93*b*, and the third ink-jet head 4 (4*c*).

An ink supply opening 25 is formed in a lower surface of the supply ink chamber 91 of each of the first to third ink-jet heads 4 (4*a* to 4*c*). As depicted in FIG. 4A, for example, part of ink flowing in the supply ink chamber 91 of the first ink-jet head 4 (4*a*) is sent to the supply common channel 41 through the ink supply opening 25. The same is applied to the supply ink chambers 91 of the second ink-jet head 4 (4*b*) and the third ink-jet head 4 (4*c*).

Figure 4B:
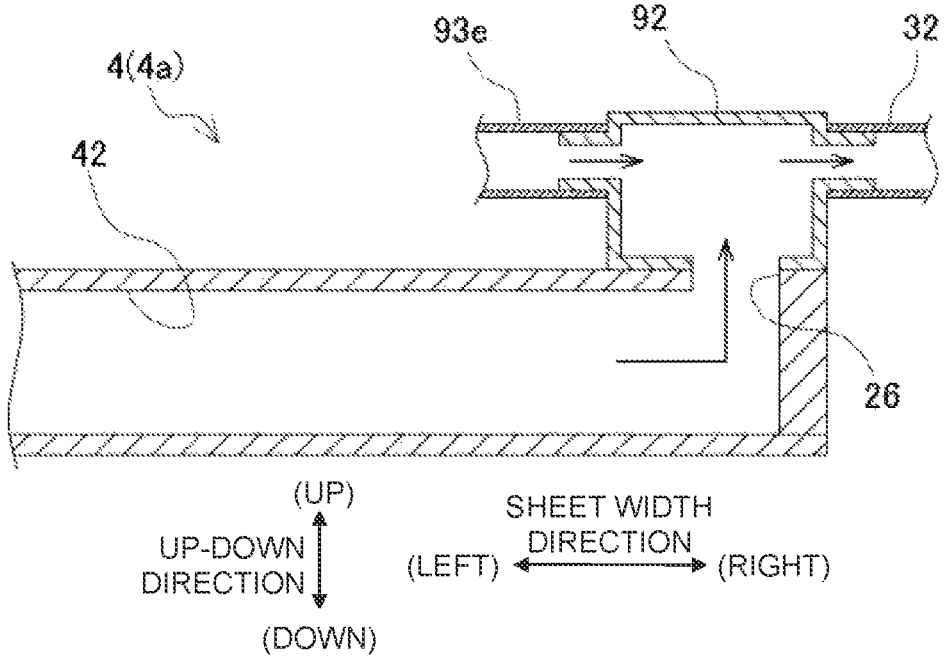
FIG. 4B is a cross-sectional view taken along a line IVB-IVB in FIG. 2.

As depicted in FIG. 4B, the return channel 32 is connected to an upper right portion of the return ink chamber 92 of the first ink-jet head 4 (4*a*). The fifth connecting channel 93*e* is connected to an upper left portion of the return ink chamber 92. The return ink chamber 92 of the first ink-jet head 4 (4*a*) is connected to the return ink chamber 92 of the second ink-jet head 4 (4*b*) via the fifth connecting channel 93*e*. The second ink-jet head 4 (4*b*) is connected to the return ink chamber 92 of the third ink-jet head 4 (4*c*) via the fourth connecting channel 93*d*. In the third ink-jet head 4 (4*c*), the supply ink chamber 91 is connected to the return ink chamber 92 via the third connecting channel 93*c*. That is, ink sent to the supply ink chamber 91 of the third ink-jet head 4 (4*c*) flows in the order of the third connecting channel 93*c*, the return ink chamber 92 of the third ink-jet head 4 (4*c*), the fourth connecting channel 93*d*, the return ink chamber 92 of the second ink-jet head 4 (4*b*), the fifth connecting channel 93*e*, and the return ink chamber 92 of the first ink-jet head 4 (4*a*). Ink returns to the subtank 3 through the return channel 32 connected to the return ink chamber 92 of the first ink-jet head 4 (4*a*).

An ink return opening 26 is formed in a lower surface of the return ink chamber 92 of each of the first to third ink-jet heads 4 (4*a* to 4*c*). As depicted in FIG. 4B, for example, ink flowing through the return common channel 42 is sent to the return ink chamber 92 through the ink return opening 26. The same is applied to the return ink chambers 92 of the second ink-jet head 4 (4*b*) and the third ink-jet head 4 (4*c*).

The supply common channel 41 is a channel through which ink that is sent from the supply ink chamber 91 through the ink supply opening 25 flows. The return common channel 42 is a channel through which ink that returns to the return ink chamber 92 through the ink return opening 26 flows. The supply common channel 41 and the return common channel 42 extend in the sheet width direction. Further, an end in the sheet width direction of the supply common channel 41 is connected to an end in the sheet width direction of the return common channel 42. The supply common channel 41 communicates with the pressure chambers 45 via the inflow channels 43. Ink flowing through the supply common channel 41 flows into the pressure chambers 45 through the inflow channels 43. The return common channel 42 communicates with the pressure chambers 45 via the outflow channels 44. Ink in the pressure chambers 45 flows out into the return common channel 42 through the outflow channels 44. Further, the controller 7 described below controls a driver IC 80 (see FIG. 3) to apply electrical potential to each individual electrode (not depicted), thus changing the volume of each pressure chamber 45 and applying pressure to ink in the pressure chamber 45. This discharges ink from the nozzle 40 and printing is performed on the sheet 100. An "individual channel" of the present disclosure is configured by the nozzle 40, the inflow channel 43, the outflow channel 44, and the pressure chamber 45. Further, "an inlet of each of the individual channels" corresponds to the inflow channel 43, and "an outlet of each of the individual channels" corresponds to the outflow channel 44.

For easy understanding of FIG. 2, one subtank 3 is connected to the supply ink chamber 91 of the first ink-jet head 4 (4*a*) via one supply channel 31, and one subtank 3 is connected to the return ink chamber 92 of the first ink-jet head 4 (4*a*) via one return channel 32. The first ink-jet head 4 (4*a*) includes a set of the supply ink chamber 91, the return ink chamber 92, the ink supply opening 25, the ink return opening 26, the supply common channel 41, and the return common channel 42. However, as described above, the printer 1 actually includes the four subtanks 3 that respectively store the four colors of inks. Thus, the four subtanks 3 are actually connected to the first ink-jet head 4 (4*a*) via the four supply channels 31 and the four return channels 32. The first ink-jet head 4 (4*a*) is provided with four sets each including the supply ink chamber 91, the return ink chamber 92, the ink supply opening 25, the ink return opening 26, the supply common channel 41, and the return common channel 42. The four sets are arranged in the conveyance direction. Specifically, the subtank 3 storing black ink is connected to the set of the supply ink chamber 91 and the return ink chamber 92 corresponding to black ink via the supply channel 31 and the return channel 32 corresponding to black ink. In the ink-jet head 4, black ink flows through the set of the supply common channel 41 and the return common channel 42 corresponding to black ink. The same is applied to inks of yellow, cyan, and magenta. Similar to the inkjet head 4 (4*a*), each of the second ink-jet head 4(4*b*) and the third ink-jet head 4 (4*c*) is provided with four sets each including the supply ink chamber 91, the return ink chamber 92, the ink supply opening 25, the ink return opening 26, the supply common channel 41, and the return common channel 42. The four sets are arranged in the conveyance direction.

The circulation pump 10 (a "first pump" of the present disclosure) is provided between the subtank 3 and the supply ink chamber 91 of the first ink-jet head 4 (4*a*). Driving the circulation pump 10 sends ink in the subtank 3 to the ink supply opening 25 through the supply channel 31, and ink outflowing from the ink return opening 26 returns to the subtank 3 through the return channel 32. The circulation pump 10 is driven by a circulation motor 16. The pressure of ink flowing through the supply channel 31 and the return channel 32 is adjusted by controlling the number of rotations of the circulation motor 16. The circulation pump 10 is exemplified by, for example, a tube pump or a gear pump.

The first pressure sensor 11 that measures the pressure of ink in the supply channel 31 is provided between the circulation pump 10 and the supply ink chamber 91 of the first ink-jet head 4 (4*a*). The second pressure sensor 12 that measures the pressure of ink in the return channel 32 is provided between the subtank 3 and the return ink chamber 92 of the first ink-jet head 4 (4*a*).

A filter 13 for removing foreign matters is provided between the circulation pump 10 and the first pressure sensor 11. When ink sent from the subtank 3 to the ink-jet head 4 through the supply channel 31 contains foreign matters, the foreign matters in ink are removed by the filter 13. This inhibits the foreign matters from entering the nozzles 40.

A damper 14 is disposed between the circulation pump 10 and the filter 13. The damper 14 inhibits ink pressure variation which may otherwise be caused in the supply channel 31 due to pulsation of the circulation pump 10 being driven. The damper 14 may be a resin container of which opened upper surface is covered with a film. Waves caused by the pulsation of the circulation pump 10 (i.e., ink pressure variation) are absorbed by repeating expansion and contraction of the film of the upper surface of the damper 14. This inhibits the ink pressure variation caused by the pulsation of the circulation pump 10. Further, a damper 15 is disposed between the second pressure sensor 12 and the subtank 3. The damper 15 inhibits ink pressure variation which may otherwise be caused in the return channel 32 due to pulsation of the circulation pump 10 being driven. A configuration of the damper 15 may be similar to that of the damper 14. Any one of the damper 14 and the damper 15 may be provided, or neither the damper 14 nor the damper 15 may be provided.

An openable/closable return valve 61 is provided between the subtank 3 and the damper 15. The return valve 61 is in an open state when the circulation pump 10 is being driven. The return valve 61 is in a closed state when the circulation pump 10 is not driven. The reason why the return valve 61 is in the closed state when the circulation pump 10 is not driven is to inhibit ink from flowing reversely from the subtank 3 to the ink-jet head 4 through the return channel 32. The damper 15 also inhibits ink pressure variation which may otherwise be caused in the return channel 32 when the return valve 61 is opened or closed.

A position of the supply channel 31 between the filter 13 and the damper 14 is connected to a position of the return channel 32 between the subtank 3 and the return valve 61 via a bypass channel (detour channel) 35. The bypass channel 35 is provided with an openable/closable bypass valve (detour valve) 36. Details of the bypass channel 35 and the bypass valve 36 are explained below together with explanation of a suction purge process (see S1 of FIG. 5).

In order to discharge air bubbles mixed into the ink in the vicinity of the nozzles 40 and to inhibit the increase in viscosity of ink in the vicinity of the nozzles 40, the circulation pump 10 provided in the supply channel 31 is driven to circulate ink in the ink-jet head 4. In this configuration, when a channel resistance of the return channel 32 is high or when the pressure of ink flowing through the return channel 32 is high, positive pressure may be applied to meniscuses formed in the nozzles 40, which may break the meniscuses of ink and ink may leak from the nozzles 40.

Thus, in the first embodiment, a negative pressure pump 50 (a "second pump" of the present disclosure) is further provided to inhibit excessive positive pressure that may otherwise be applied to the meniscuses. The negative pressure pump 50 is connected to the subtank 3 via, a gas channel 33. The gas channel 33 is, for example, a tube or the like. As depicted in FIG. 2, a front end of the gas channel 33 connected to the subtank 3 extends to a position above a liquid level of ink stored in the subtank 3. This inhibits ink stored in the subtank 3 from entering the gas channel 33. The negative pressure pump 50 communicates with the atmosphere. Driving the negative pressure pump 50 absorbs gas in the subtank 3 and discharges the gas to the atmosphere. The inside of the subtank 3 has negative pressure by discharging gas in the subtank 3, thus reducing the pressure of ink in the return channel 32 that communicates with the subtank 3. This inhibits excessive positive pressure that may otherwise be applied to the meniscuses. The negative pressure pump 50 is driven by a negative pressure motor 51 (a "motor" of the present disclosure). An amount of gas discharged from the inside of the subtank 3 to the atmosphere by the negative pressure pump 50 is adjusted by controlling the number of rotations of the negative pressure motor 51.

A buffer 52 is provided between the negative pressure pump 50 and the subtank 3. The buffer 52 removes ink mixed into gas absorbed from the inside of the subtank 3 by use of the negative pressure pump 50. When ink adheres to the negative pressure pump 50 and then dries, ink may become foreign matter to lower the function of the negative pressure pump 50. The buffer 52 inhibits ink from entering the negative pressure pump 50, thus making it possible to keep the function of the negative pressure pump 50 normal.

The buffer 52 inhibits gas pressure variation which may otherwise be caused in the gas channel 33 by pulsation of the negative pressure pump 50 being driven. When a predefined amount of gas is absorbed by the negative pressure pump 50, the gas pressure variation caused in the gas channel 33 when the predefined amount of gas is absorbed from a part having a large gas volume is smaller than that when the predefined amount of gas is absorbed from a part having a small gas volume. The part having the large gas volume can be constantly made by accumulating a certain amount of gas in the buffer 52, and thus it is possible to inhibit the gas pressure variation that may otherwise be caused in the gas channel 33. When an image is to be printed on the sheet 100 by discharging ink from the nozzles 40 in a state where the gas pressure variation in the gas channel 33 is large, an effect on image quality of the image is large. The buffer 52 reduces the effect, caused by the pressure variation, on the image quality of the image to be printed.

The buffer 52 may be, for example, a closed (airtight) container of which inside is hollow. In this case, the buffer 52 includes an inlet formed at the first end side of its upper surface, an outlet formed at the second end side of its upper surface, and plate-like ribs extending upward from a lower surface of the container up to an intermediate portion of the container. The inlet is connected to the subtank 3 via the gas channel 33. The outlet is connected to the negative pressure pump 50 via the gas channel 33. The ribs are arranged from the first end side toward the second end side. The ribs are brought into contact with inner surfaces of side walls of the closed container. Gas absorbed from the subtank 3 flows into the buffer 52 through the inlet. Gas flowing into the buffer 52 passes through the buffer 52 and is discharged to the negative pressure pump 50 side through the outlet. Ink in the gas solidifies in the buffer 52 and remains or stays in a part of the buffer 52 surrounded by the ribs, the lower surface, and the side walls.

For example, when ink is discharged from the nozzles 40 to the sheet 100 placed on the upper surface of the platen 2, ink in the subtank 3 decreases. This reduces pressure inside the subtank 3 as well as the pressure of ink in the return channel 32 communicating with the subtank 3. Accordingly, the pressure applied to the meniscuses formed in the nozzles 40 is decreased and negative pressure is eventually applied to the meniscuses. Excessive negative pressure applied to the meniscuses, however, inhibits ink from being discharged appropriately.

In order to inhibit excessive negative pressure from being applied to the meniscuses, the printer 1 is provided with an atmosphere open channel 34 through which the subtank 3 communicates with air or the atmosphere. As depicted in FIG. 2, a front end of the atmosphere open channel 34 connected to the subtank 3 extends to a position above the liquid level of ink stored in the subtank 3. Pressure inside the subtank 3 increases when gas flows from the atmosphere into the subtank 3 through the atmosphere open channel 34. It is thus possible to inhibit excessive negative pressure from being applied to meniscuses when pressure inside the subtank 3 is reduced due to ink discharge or the like. In the first embodiment, the atmosphere open channel 34 is opened at all times, and the atmosphere constantly flows into the subtank 3 through the atmosphere open channel 34. A value of a channel resistance of the atmosphere open channel 34 is set so that a gas flowing amount inflowing from the atmosphere open channel 34 per unit time is larger than a maximum ink flowing amount discharged from the nozzle 40 per unit time. It is thus possible to inhibit excessive negative pressure from being applied to the meniscus pressure when ink is discharged from the nozzle 40.

As depicted in FIG. 3, the controller 7 is electrically connected to the circulation motor 16, the negative pressure motor 51, the return valve 61, the conveyance motor 70, the driver IC 80, the first pressure sensor 11, the second pressure sensor 12, and the like. The controller 7 controls the entirety of the printer 1. Further, as depicted in FIG. 3, the controller 7 includes a Central Processing Unit (CPU) 81, a Read Only Memory (ROM) 82, a Random Access Memory (RAM) 83, an Applicant Specific Integrated Circuit (ASIC) 84, and the like. The ROM 82 stores programs executed by the CPU 81 and the ASIC 84, a variety of fixed data, and the like. The RAM 83 includes data required for executing the programs (the measurement values of the first pressure sensor 11 and the second pressure sensor 12, and the like).

<Control of Printer 1>

Figure 5:
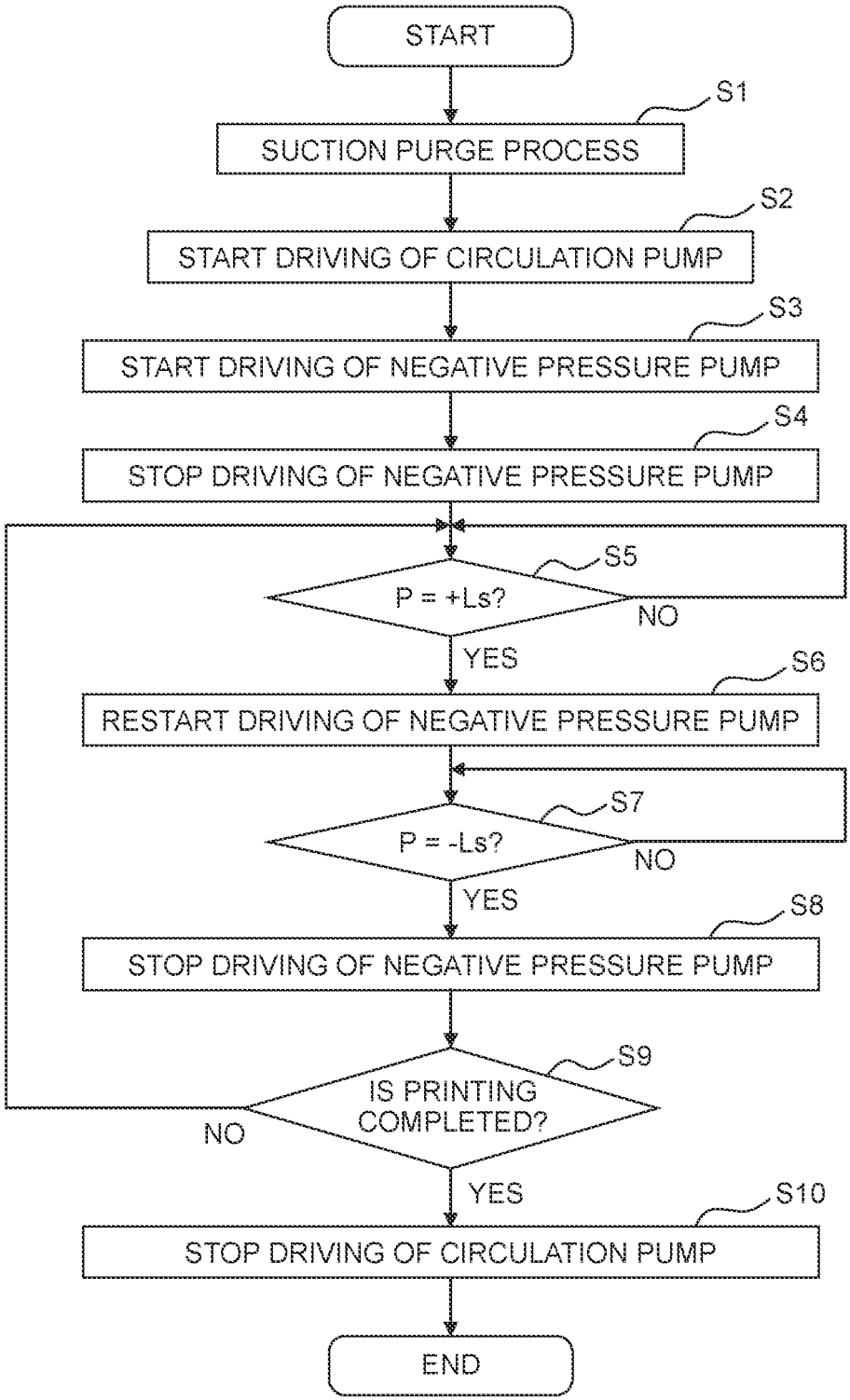
FIG. 5 is a flowchart indicating the control of the printer by a controller according to the first embodiment.
Figures 6A, 6B, 6C:
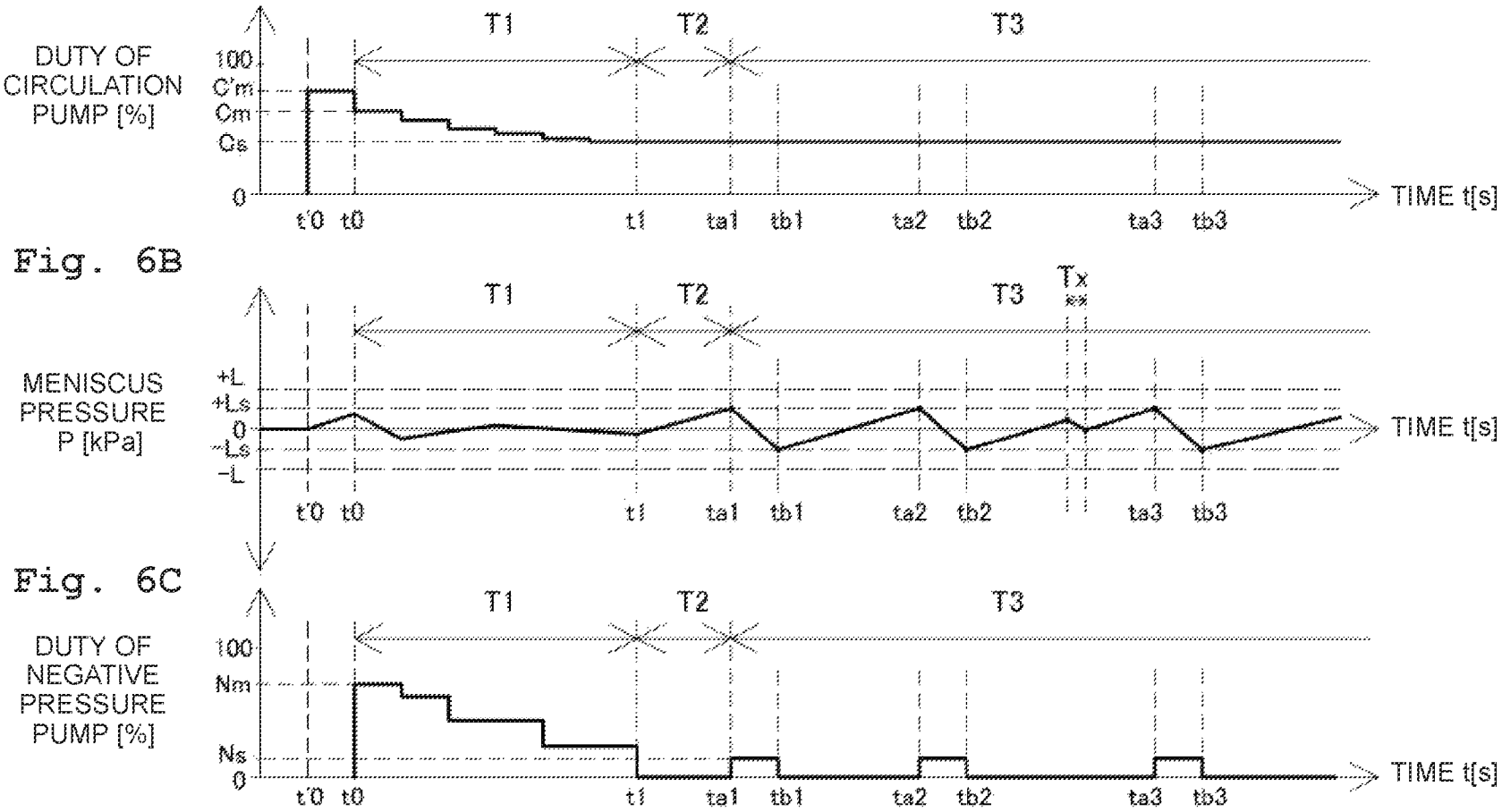
FIG. 6A is a graph indicating variation in a duty of a circulating pump with respect to elapsed time according to the first embodiment.
FIG. 6B is a graph indicating variation in a value of pressure of a meniscus formed in a nozzle with respect to elapsed time according to the first embodiment.
FIG. 6C is a graph indicating variation in a duty of a negative pressure pump with respect to elapsed time according to the first embodiment.

Referring to a flowchart of FIG. 5 and graphs of FIGS. 6A to 6C, explanation is made about the control of the printer 1 by the controller 7 when ink circulation is performed. A horizontal axis in each of FIGS. 6A to 6C indicates an elapsed time t [s]. A vertical axis in FIG. 6A indicates a duty [%] of the circulation pump 10. A vertical axis in FIG. 6B indicates a value P [kPa] of pressure of meniscus formed in the nozzle 40. A vertical axis in FIG. 6C indicates a duty [%] of the negative pressure pump 50. The elapsed time t indicated by the horizontal axis is common to FIGS. 6A to 6C. The duty value of the circulation pump 10 in FIG. 6A is 100% when the number of rotations of the circulation motor 16 is maximum. The duty value of the circulation pump 10 in FIG. 6A is 0% when the rotation of the circulation motor 16 is stopped. The duty value of the negative pressure pump 50 in FIG. 6C is 100% when the number of rotations of the negative pressure motor 51 is maximum. The duty value of the negative pressure pump in FIG. 6C is 0% when the rotation of the negative pressure motor 51 is stopped.

The meniscus pressure P in FIG. 6B is pressure applied to the meniscus formed in the nozzle 40. The meniscus pressure P is automatically calculated by the controller 7 based on the measurement values of the first pressure sensor 11 and the second pressure sensor 12. More specifically, the controller 7 calculates the meniscus pressure P by correcting the measurement values of the first pressure sensor 11 and the second pressure sensor 12 based on a channel resistance from the first pressure sensor 11 to the nozzle 40 and a channel resistance from the second pressure sensor 12 to the nozzle 40.

The flowchart of FIG. 5 starts, for example, when the printer 1 is turned on. In this situation, the bypass valve 36 and the return valve 61 are closed. At first, the controller 7 opens the bypass valve 36 and executes the suction purge process using a purge unit (not depicted) to maintain or recover discharge performance of the ink-jet head 4 (step S1).

The purge unit includes a nozzle cap (not depicted) that covers the nozzles 40 of the ink-jet head 4, a suction pump (not depicted) for sucking ink from the nozzles 40 covered with the nozzle cap, and a waste liquid tank (not depicted) for holding the sucked ink. Driving the suction pump by the controller 7 causes ink in the subtank 3 to flow to the ink-jet head 4. Ink flowing to the ink-jet head 4 passes through the nozzles 40 and flows into the waste liquid tank of the purge unit. In this situation, since the return valve 61 is closed, ink sucked from the subtank 3 can not pass a part provided with the damper 15 of the return channel 32. Further, since a channel resistance of the circulation pump 10 is large, a lame part of ink sucked from the subtank 3 avoids a part provided with the circulation pump 10 and the damper 14 of the supply channel 31. The large part of ink sucked from the subtank 3 passes through the return channel 32, the bypass channel 35, and a part provided with the filter 13 and the first pressure sensor 11 of the supply channel 31 in that order, and then flows to the ink-jet head 4. When the suction purge is executed, the pressure of ink flowing from the subtank 3 to the ink-jet head 4 is required to be equal to or more than a predefined value. Since ink flowing from the subtank 3 to the ink-jet head 4 passes through the bypass channel 35, it is possible to avoid pressure absorption by the damper 14 and early obtain the pressure required for the suction purge. Accordingly, the ink amount consumed by the suction purge as well as the time required for the suction purge process can be reduced.

After completion of the suction purge process, the controller 7 closes the bypass valve 36. Then, the controller 7 opens the return valve 61 when t=t'0 is satisfied. The controller 7 rotates the circulation motor 16 and starts the driving of the circulation pump 10 (step S2). The duty of the circulation pump 10 at this time is defined as C'm (see FIG. 6A). The meniscus pressure P increases (see FIG. 61-3) by continuing the driving of the circulation pump 10 in a state where the duty C'm is maintained.

When t=t0 is satisfied, the controller 7 starts the driving of the negative pressure pump 50 through the rotation of the negative pressure motor 51 and reduces the number of rotations of the circulation motor 16 (step S3). The meniscus pressure P that keeps increasing does not exceed +L in a period of t=t'0 to t0. The duty of the negative pressure pump 50 when t=t0 is satisfied is defined as Nm, and the duty of the circulation pump 10 is defined as Cm (Cm<C'm). The controller 7 continues the driving of the circulation pump 10 and the negative pressure pump 50 while controlling the number of rotations of the circulation motor 16 and the negative pressure motor 51 so that the meniscus pressure P is in a predefined range (−L≤P≤+L) in the first period T1 that starts when the driving of the circulation pump 10 and the negative pressure pump 50 starts (t=t0). Further, the controller 7 gradually reduces the number of rotations of the circulation motor 16 and the negative pressure motor 51 so that the duties of the circulation pump 10 and the negative pressure pump 50 are reduced gradually in the first period T1 (see FIG. 6A and FIG. 6C). In this situation, the controller 7 drives the negative pressure pump 50 so that a gas flowing amount discharged from the inside of the subtank 3 by use of the negative pressure pump 50 per unit time is constantly larger than the gas flowing amount inflowing from the atmosphere open channel 34 per unit time. The predefined range (−L≤P≤+L) is a range of the meniscus pressure P in which ink is discharged appropriately without ink leakage from the nozzle 40. The ink leakage may be caused when the meniscus of ink is broken. L is, for example, 3 kPa.

When t=t1 is satisfied, the controller 7 stops the rotation of the negative pressure motor 51 to stop the driving of the negative pressure pump 50 in the state where the driving of the circulation pump 10 is continued (step S4). As described above, the duty of the circulation pump 10 is gradually reduced, and the duty of the circulation pump 10 when t=t1 is satisfied is Cs (Cs<Cm) (see FIG. 6A). The time t1 may be a time set in advance, or a time at which it is determined that the meniscus pressure is further stabilized (e.g., a time at which the meniscus pressure P is equal to or more than a predefined time and satisfies −L/2≤P≤+L/2). Further, the time t1 may be determined by any other method. A period from when the driving of the circulation pump 10 and the negative pressure pump 50 is started (t=t0) to when the driving of the negative pressure pump 50 is stopped (t=t1) is defined as the first period T1 (see FIGS. 6A to 6C). In the second period T2 after the first period T1 (i.e., in the second period T2 starting at t=t1), the controller 7 controls the rotation of the circulation motor 16 so that the duty of the circulation pump 10 is constant at Cs. The duty of the circulation pump 10 is constant at Cs also in the third period T3 described below.

In the first period T1, pressure in the subtank 3 is negative pressure by discharging gas by use of the negative pressure pump 50. The meniscus pressure P is thus stabilized in the predefined range (−L≤P≤+L) when the driving of the negative pressure pump 50 is stopped in the state where the driving of the circulation pump 10 is continued in the second period T2. However, since gas constantly flows into the subtank 3 from the atmosphere through the atmosphere open channel 34 opened at all times, pressure in the subtank 3 increases with time after the driving of the negative pressure pump 50 is stopped. This increases the meniscus pressure P.

Subsequently, the controller 7 determines whether the meniscus pressure P reaches +Ls (Ls<L) based on the measurement values of the first pressure sensor 11 and the second pressure sensor 12 (step S5). The value Ls may be any value satisfying Ls<L. The value Ls is set in advance. The controller 7 maintains the state where the driving of the negative pressure pump 50 is stopped (S5: NO) while continuing the driving of the circulation pump 10 at the duty Cs, until the meniscus pressure P reaches +Ls.

When the meniscus pressure P reaches +Ls (S5: YES), the controller 7 rotates the negative pressure motor 51 and restarts the driving of the negative pressure pump 50 (step S6). The time t when the driving of the negative pressure pump 50 is restarted is defined as ta1. The duty of the negative pressure pump 50 when t=ta1 is satisfied is defined as Ns. The duty Ns is a duty of the negative pressure pump 50 so that the gas flowing amount discharged from the inside of the subtank 3 by use of the negative pressure pump 50 per unit time is larger than the gas flowing amount inflowing from the atmosphere open channel 34 per unit time. A period from when the driving of the negative pressure pump 50 is stopped (t=t1) to when the driving of the negative pressure pump 50 is restarted for the first time (t=ta1) is defined as the second period T2. A period after the second period T2 (i.e., a period after t=ta1) is defined as the third period T3. In the third period, the controller 7 restarts the driving of the negative pressure pump 50, and continues the driving of the negative pressure pump 50 in a state where the duty Ns is maintained. This reduces the meniscus pressure P.

Subsequently, the controller 7 determines whether the meniscus pressure P reaches −Ls based on the measurement values of the first pressure sensor 11 and the second pressure sensor 12 (step S7). The controller 7 continues the driving of the circulation pump 10 at the duty Cs and continues the driving of the negative pressure pump 50 at the duty Ns, until the meniscus pressure P reaches −Ls (S7: NO).

When the meniscus pressure P reaches −Ls (S7: YES), the controller 7 stops the driving of the negative pressure pump 50 (step S8). The time t at which the driving of the negative pressure pump 50 is stopped is defined as a time tb1. Subsequently, the controller 7 determines whether printing on the sheet 100 is completed (step S9). When printing is not completed (S9: NO), the controller 7 returns to the step S5 and determines whether the meniscus pressure P reaches +Ls. When the controller 7 returns to the step S5, the third period T3 is continued. In the third period T3, the controller 7 repeats the stop and restart of driving of the negative pressure pump 50 so that the meniscus pressure P is in the predefined range (−L≤P≤+L) in the state where the driving of the circulation pump 10 is continued. That is, the negative pressure pump 50 is driven intermittently. In FIGS. 6A to 6C, each of ta1, ta2, and ta3 is a time at which driving of the negative pressure pump 50 is restarted, and each of tb1, tb2, and tb3 is a time at which the driving of the negative pressure pump 50 is stopped. In the first embodiment, the controller 7 controls the rotation of the negative pressure motor 51 so that the negative pressure pump 50 has the duty Ns in each of the periods ta1 to tb1, ta2 to tb2, and ta3 to tb3. However, the negative pressure pump 50 may have different duties in the respective periods.

Ink is discharged from the nozzle 40 to the sheet 100 in the third period T3. Discharging ink from the nozzle 40 reduces ink in the subtank 3, which consequently reduces the meniscus pressure P. For example, in FIG. 6B, ink is discharged from the nozzle 40 in a period Tx, thus reducing the meniscus pressure P. Inclination of a straight line when the meniscus pressure P is reduced by ink discharge is larger as the amount of ink discharged is larger. Inclination of the straight line is smaller as the amount of ink discharged is smaller.

When the controller 7 has determined that printing is completed (S9: YES), the controller 7 stops the driving of the circulation pump 10 (step S10). In the step S10, the controller 7 uniformly or equally reduces the number of rotations of the circulation motor 16 in the step S10. This reduces the duty of the circulation pump 10 linearly. Further, the controller 7 rotates the negative pressure motor 51 to drive the negative pressure pump 50 intermittently, while at the same time uniformly or equally reducing the number of rotations of the circulation motor 16. On this occasion, the controller 7 controls the number of rotations of the negative pressure motor 51 so that the meniscus pressure P is in the predefined range (−L≤P≤+L).

When the driving of the circulation pump 10 is stopped, the intermittent driving of the negative pressure pump 50 is also stopped and the printer 1 is turned off. This ends the operation of the printer 1 by the controller 7 when ink circulation is performed.

[Effects]

In the first embodiment, the printer 1 includes the circulation pump 10 configured to send ink in the subtank 3 to the ink-jet head 4, and the negative pressure pump 50 configured to discharge gas in the subtank 3. The circulation pump 10 is provided in the supply channel 31 and the negative pressure pump 50 is connected to the subtank 3 via the gas channel 33. In the first period T1, the driving of the circulation pump 10 and the negative pressure pump 50 is continued. In the second period T2, the driving of the negative pressure pump 50 is stopped in the state where the driving of the circulation pump 10 is continued. When the inside of the subtank has predefined pressure by driving the negative pressure pump 50 and discharging gas in the first period T1, negative pressure in the return channel 32 that communicates with the inside of the subtank 3 is maintained without driving the negative pressure pump 50 after the inside of the subtank 3 has the predefined pressure. Thus, ink can circulate while inhibiting excessive positive pressure from being applied to meniscuses when the driving of the negative pressure pump 50 is stopped in the second period T2. It is thus possible to reduce power consumption due to the driving of the negative pressure pump 50 by stopping the driving of the negative pressure pump 50 in the second period T2.

In the first embodiment, the controller 7 intermittently drives the negative pressure pump 50 in the third period T3. This repeats the period in which the driving of the circulation pump 10 and the negative pressure pump 50 is continued (e.g., ta1 to tb1, see FIGS. 6A to 6C) and the period in which the driving of the negative pressure pump 50 is stopped in the state where the driving of the circulation pump 10 is continued (e.g., tb1 to ta2, see FIGS. 6A to 6C). It is possible to inhibit excessive positive pressure from being applied to meniscuses by driving the negative pressure pump 50 when pressure to meniscuses increases. Since the negative pressure pump 50 is driven intermittently, it is possible to reduce power consumption caused by the driving of the negative pressure pump 50 compared to a case in which the negative pressure pump 50 is driven at all times.

Further, in the first embodiment, the controller 7 determines a time at which the driving of the negative pressure pump 50 is started in the third period T3 and a time at which the driving of the negative pressure pump 50 is stopped in the third period T3 based on the measurement values of the first pressure sensor 11 and the second pressure sensor 12. It is thus possible to start and stop the driving of the negative pressure pump 50 at an appropriate timing. Further, it is possible to inhibit excessive positive pressure from being applied to meniscuses and to reduce power consumption.

In the first embodiment, the printer 1 includes the atmosphere open channel 34 through which the subtank 3 is opened to the atmosphere. Discharging ink from the nozzle 40 reduces the pressure in the subtank 3 as well as the pressure of ink in the return channel 32 that communicates with the subtank 3. This reduces the pressure applied to the meniscus. When the discharge amount of ink from the nozzle 40 is large, excessive negative pressure is applied to the meniscus and ink discharge can not be performed properly. The increase in negative pressure in the subtank 3 is thus inhibited by introducing gas from the atmosphere into the subtank 3 through the atmosphere open channel 34. This inhibits excessive negative pressure from being applied to the meniscus.

In the first embodiment, the atmosphere open channel 34 is opened at all times. It is possible to constantly inhibit excessive negative pressure from being applied to the meniscus owing to the atmosphere open channel 34 that is opened at all times, when ink is discharged from the nozzle 40.

In the first embodiment, the channel resistance of the atmosphere open channel 34 is set so that the gas flowing amount inflowing from the atmosphere open channel 34 per unit time is larger than the maximum ink flowing amount discharged from the nozzle 40 per unit time. It is thus possible to inhibit excessive negative pressure from being applied to the meniscus, when a large amount of ink is discharged from the nozzle 40. Further, the controller 7 drives the negative pressure pump 50 so that the gas flowing amount discharged from the inside of the subtank 3 by use of the negative pressure pump 50 per unit time is larger than the gas flowing amount inflowing from the atmosphere open channel 34 per unit time. It is thus possible to inhibit positive pressure in the subtank 3 from being excessively increased due to the inflowing of gas from the atmosphere open channel 34 to the subtank 3, thus consequently inhibiting excessive positive pressure from being applied to the meniscus.

In the first embodiment, the supply channel 31 communicates with an outlet of the subtank 3 and the inflow channels 43, and the return channel 32 communicates an inlet of the subtank 3 and the outflow channels 44. Thus, ink circulation with low power consumption is possible in the printer 1 having the individual channels each configured by the nozzle 40, the inflow channel 43, the outflow channel 44, and the pressure chamber 45.

Second Embodiment

The second embodiment of the present disclosure is explained below. The constitutive parts or components, which are the same as or equivalent to those of the first embodiment, are designated by the same reference numerals, any explanation therefor is omitted as appropriate.

Figure 7:
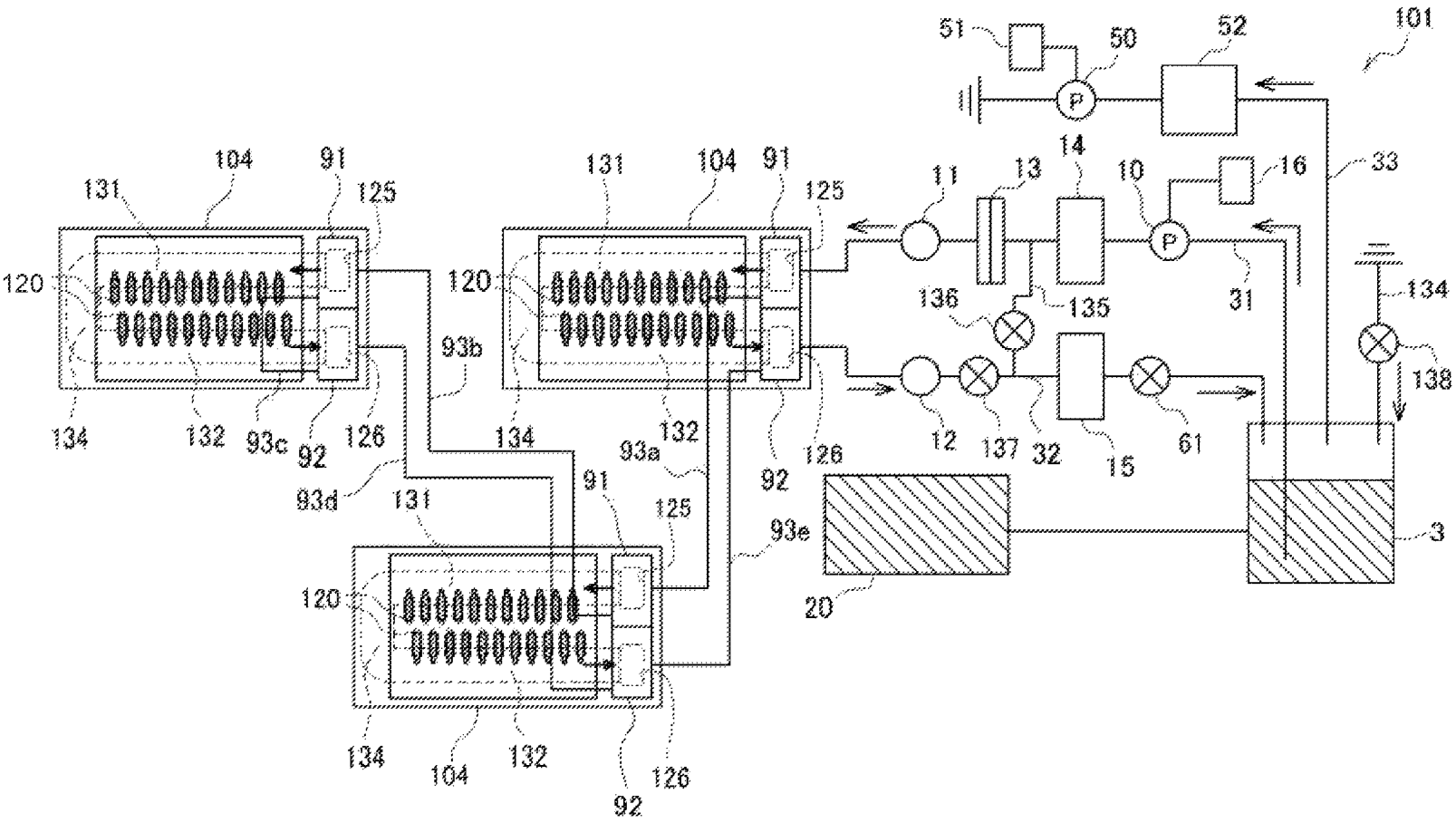
FIG. 7 depicts a channel configuration from the subtank to the ink-jet head according to a second embodiment.

As depicted in FIG. 7, a printer 101 according to the second embodiment includes an atmosphere open channel 134 through which the subtank 3 communicates with air or the atmosphere, and an atmosphere open valve 138 (a "valve" of the present disclosure) that opens or closes the atmosphere open channel 134.

An ink-jet head 104 according to the second embodiment includes nozzles 120 arranged in the sheet width direction, the first manifold 131 that communicates with part of the nozzles 120, and the second manifold 132 that communicates with remaining nozzles 120. The first manifold 131 and the second manifold 132 extend in the sheet width direction. The first end of the first manifold 131 communicates with an ink supply opening 125, and the first end of the second manifold 132 communicates with an ink return opening 126. The second end of the first manifold 131 is connected to the second end of the second manifold 132 via a connection channel 134. That is, ink flowing from the supply ink chamber 91 into the first manifold 131 through the ink supply opening 125 passes through the connection channel 134 and reaches the second manifold 132. After that, ink passes through the ink return opening 126 and flows to the return ink chamber 92. Part of ink is supplied to the nozzles 120 in a process in which ink flows from the ink supply opening 125 to the ink return opening 126. Connection between the three ink-jet heads 104 is similar to the first embodiment.

A position of the supply channel 31 between the filter 13 and the damper 14 is connected to a position of the return channel 32 between the second pressure sensor 12 and the damper 15 via a bypass channel 135. The bypass channel 135 is provided with an openable/closable first bypass valve 136. An openable/closable second bypass valve 137 is provided at a position between the second pressure sensor 12 and the position at which the bypass channel 135 is connected to the return channel 32. Details of the bypass channel 135, the first bypass valve 136, and the second bypass valve 137 are explained below together with explanation of a suction purge process (see S21 of FIG. 8) described below.

<Control of Printer 101>

Figure 8:
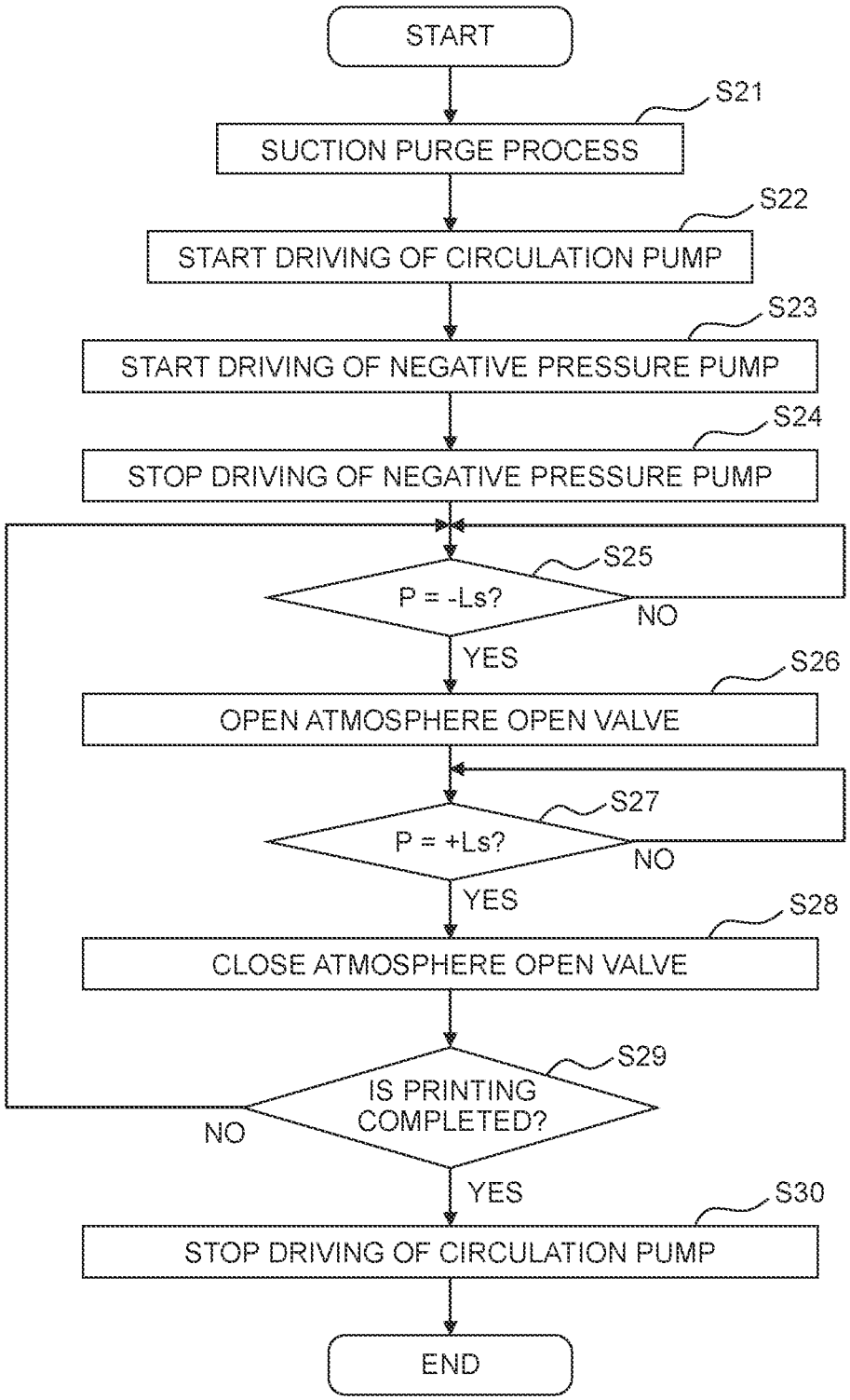
FIG. 8 is a flowchart indicating the control of the primer by the controller according to the second embodiment.
Figure 9A:
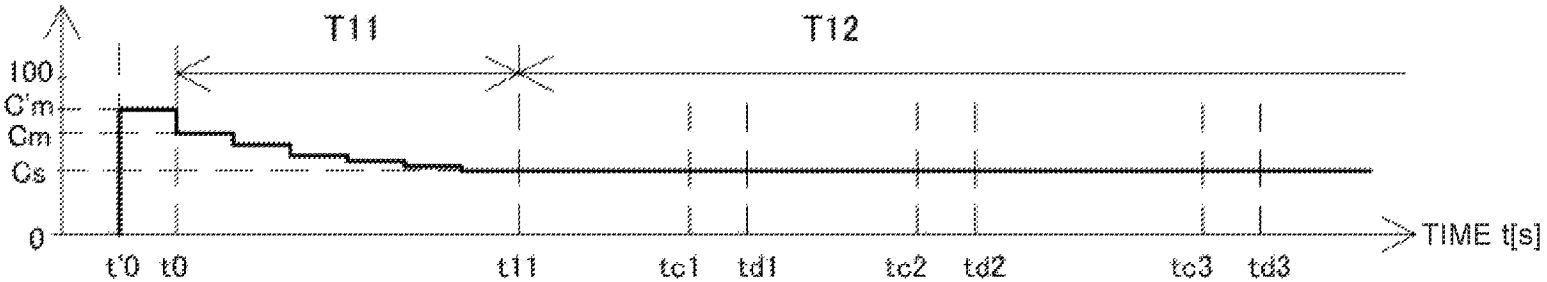
FIG. 9A is a graph indicating variation in a duty of the circulating pump with respect to elapsed time according to the second embodiment.
Figure 9B:
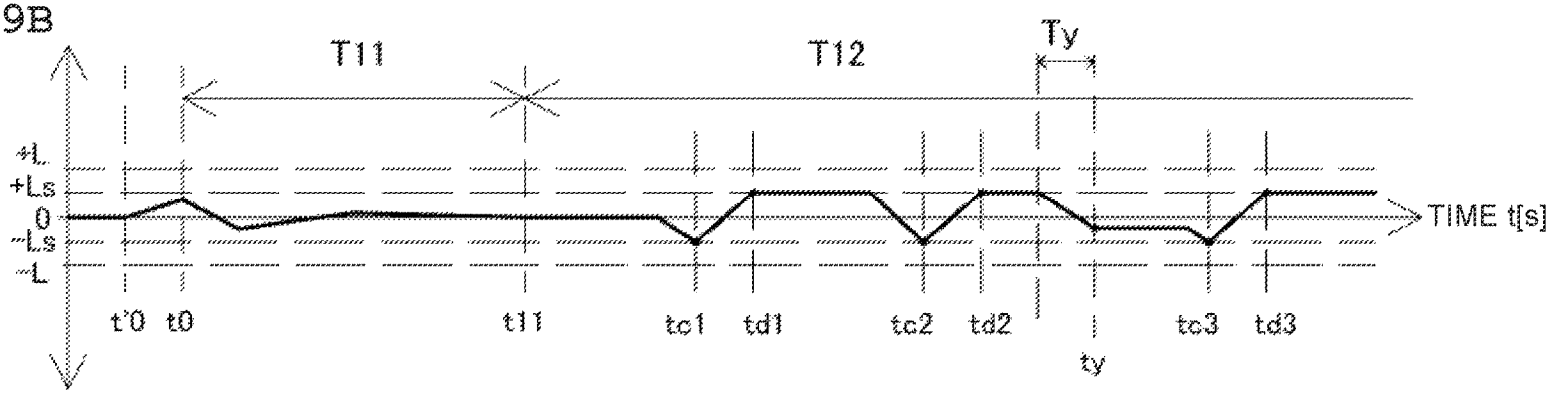
FIG. 9B is a graph indicating variation in a value of pressure of a meniscus formed in a nozzle with respect to elapsed time according to the second embodiment.
Figure 9C:
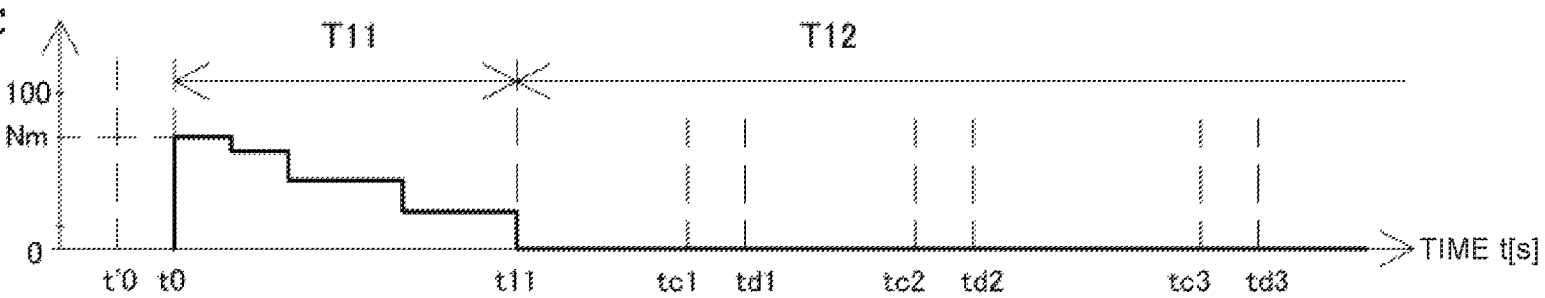
FIG. 9C is a graph indicating variation in a duty of the negative pressure pump with respect to elapsed time according to the second embodiment.

Referring to a flowchart of FIG. 8 and the graphs of FIG. 9A to 9C, explanation is made about the control of the printer 101 by the controller 7 when ink circulation is performed. A horizontal axis in each of FIGS. 9A to 9C indicates an elapsed time t [s]. A vertical axis in FIG. 9A indicates a duty [%] of the circulation pump 10. A vertical axis in FIG. 9B indicates a value P [kPa] of pressure of meniscus formed in the nozzle 40. A vertical axis in FIG. 9C indicates a duty [%] of the negative pressure pump 50. The elapsed time t indicated by the horizontal axis is common to FIGS. 9A to 9C. The duty values in FIGS. 9A and 9C are defined similarly as those in FIGS. 6A and 6C. The meniscus pressure P in FIG. 9B is defined similarly as that in FIG. 6B.

The flowchart of FIG. 8 starts, for example, when the printer 101 is turned on. On this occasion, the return valve 61, the first bypass valve 136, the second bypass valve 137, and the atmosphere open valve 138 are closed. At first, the controller 7 executes the suction purge process by the purge unit (not depicted) with the return valve 61 and the first bypass valve 136 being opened (step S21).

Driving the suction pump (not depicted) by the controller 7 causes ink in the subtank 3 to flow to the ink-jet head 4. Ink flowing to the ink-jet head 4 passes through the nozzles 120 and flows into the waste liquid tank of the purge unit. In this situation, since the second bypass valve 137 is closed, ink sucked from the subtank 3 can not pass through a part provided with the second pressure sensor 12 of the return channel 32. Further, since the channel resistance of the circulation pump 10 is large, a large part of ink sucked from the subtank 3 avoids a part provided with the circulation pump 10 and the damper 14 of the supply channel 31. Thus, the large part of ink sucked from the subtank 3 flows through the part provided with the damper 15 of the return channel 32, the bypass channel 135, and the part provided with the filter 13 and the first pressure sensor 11 of the supply channel 31 in that order, and flows to the ink-jet head 104. Foreign matters may be mixed into ink flowing through the dampers 14 and 15. If ink containing foreign matters enters the ink-jet head 104 by the suction purge process, failure or malfunction may be caused. In the second embodiment, ink that flows from the subtank 3 to the ink-jet head 104 passes through the damper 15 and then through the filter 13 and thus foreign matters in ink can be removed. This inhibits the failure in the ink-jet head 4 which may otherwise be caused by the suction purge process.

Alter completion of the suction purge process, the controller 7 closes the first bypass valve 136 and opens the second bypass valve 137. When t=t'0 is satisfied, the controller 7 rotates the circulation motor 16 and starts the driving of the circulation pump 10 (step 22). The circulation pump 10 has a duty of C'm at this time (see FIG. 9A). The meniscus pressure P increases by continuing the driving of the circulation pump 10 in a state where the duty C'm is maintained (see FIG. 9B).

When t=t0 is satisfied, the controller 7 starts the driving of the negative pressure pump 50 through the rotation of the negative pressure motor 51, and reduces the number of rotations of the circulation motor 16 (step S23). In the period of t=t'0 to t0, the meniscus pressure P keeps increasing, but does not exceed +L. The duty of the negative pressure pump 50 when t=t0 is satisfied is defined as Nm, and the duty of the circulation pump 10 is defined as Cm (Cm<C'm). The controller 7 continues the driving of the circulation pump 10 and the negative pressure pump 50 while controlling the number of rotations of the circulation motor 16 and the negative pressure motor 51 so that the meniscus pressure P is in the predefined range (−L≤P≤+L) in the first period T11 that starts when the driving of the circulation pump 10 and the negative pressure pump 50 starts (t=t0). Further, the controller 7 gradually reduces the number of rotations of the circulation motor 16 and the negative pressure motor 51 so that the duties of the circulation pump 10 and the negative pressure pump 50 are gradually reduced in the first period T11 (see FIG. 9A and FIG. 9C).

When t=t11 is satisfied, the controller 7 stops the rotation of the negative pressure motor 51 to stop the driving of the negative pressure pump 50 in the state where the driving of the circulation pump 10 is continued (step S24). As described above, the duty of the circulation pump 10 is gradually reduced, and the duty of the circulation pump 10 when t=t11 is satisfied is Cs (Cs<Cm) (see FIG. 9A). The time t11 is defined similarly as the time t1 of the first embodiment. A period from when the driving of the circulation pump 10 and the negative pressure pump 50 is started (t=t0) to when the driving of the negative pressure pump 50 is stopped (t=t11) is defined as the first period T11 (see FIGS. 9A to 9C). In the second period T12 after the first period T11 (i.e., in the second period T2 starting at t=t11), the controller 7 controls the rotation of the circulation motor 16 so that the duty of the circulation pump 10 is constant at Cs.

When ink is discharged from the nozzles 120 in the second period T12, the meniscus pressure P is reduced. The controller 7 determines whether the meniscus pressure P reaches −Ls (Ls<L) based on the measurement values of the first pressure sensor 11 and the second pressure sensor 12 (step S25). The controller 7 stops the driving of the negative pressure pump 50 while continuing the driving of the circulation pump 10 at the duty Cs until the meniscus pressure P reaches −Ls, and further maintains the closed state of the atmosphere open valve 138 (S25: NO).

When the meniscus pressure P reaches −Ls (S25: YES), the controller 7 opens the atmosphere open valve 138 (step S26). The time t at which the controller 7 opens the atmosphere open valve 138 is defined as a time tc1. Opening the atmosphere open valve 138 allows gas to flow from the atmosphere into the subtank 3 through the atmosphere open channel 134. This increases pressure in the subtank 3, which consequently increases the meniscus pressure P.

It is assumed that the meniscus pressure P is reduced by discharging ink from the nozzles 120 in the second period T12. In this case, when the meniscus pressure P does not reach −Ls, the controller 7 maintains the closed state of the atmosphere open valve 138. For example, in FIG. 9B, ink is discharged from the nozzles 120 in a period Ty and the meniscus pressure P is reduced. However, the meniscus pressure P does not reach −Ls at the time at which ink discharge is stopped (t=ty). The controller 7 thus maintains the closed state without opening the atmosphere open valve 138, when t=ty is satisfied.

Subsequently, the controller 7 determines whether the meniscus pressure P reaches +Ls based on the measurement values of the first pressure sensor 11 and the second pressure sensor 12 (step S27). The controller 7 maintains the open state of the atmosphere pressure valve 138 until the meniscus pressure P reaches +Ls (step S27: NO).

When the meniscus pressure P reaches +Ls (S27: YES), the controller 7 closes the atmosphere open valve 138 (step S28). The time t at which the controller 7 closes the atmosphere open valve 138 is defined as a time td1. Subsequently, the controller 7 determines whether printing on the sheet 100 is completed (step S29). When printing is not completed (S29: NO), the controller 7 returns to the step S25 and determines whether the meniscus pressure P reaches −Ls. When the controller 7 returns to the step S25, the second period T12 is continued. In the second period T12, the controller 7 repeats the opening and closing of the atmosphere open valve 138 so that the meniscus pressure P is in the predefined range (−L≤P≤+L) in the state where the driving of the circulation pump 10 is continued. In FIGS. 9A to 9C, each of tc1, tc2, and tc 3 is a time at which the atmosphere open valve 138 has the open state, and each of td1, td2, and td3 is a time at which the atmosphere open valve 138 has the closed state. In the second period T12, the driving of the negative pressure pump 50 is stopped.

When the controller 7 has determined that printing is completed (S29: YES), the controller 7 stops the driving of the circulation pump 10 (step S30). In the step S30, the controller 7 intermittently drives the negative pressure pump 50 per predefined time. Further, the controller 7 gradually reduces the number of rotations of the circulation motor 16 while at the same time intermittently driving the negative pressure pump 50. On this occasion, the controller 7 controls the number of rotations the circulation motor 16 so that the meniscus pressure P is in the predefined range (−L≤P≤+L).

When the driving of the circulation pump 10 is stopped, the intermittent driving of the negative pressure pump 50 is also stopped and the printer 101 is turned off. This ends the operation of the printer 101 by the controller 7 when ink circulation is performed.

[Effects]

According to the second embodiment, the printer 101 includes the atmosphere open channel 134, and the atmosphere open valve 138 that opens and closes the atmosphere open channel 134. In the first period T11 in which the circulation pump 10 and the negative pressure pump 50 are driven, the atmosphere open valve 138 is closed. In the second period T12 in which the driving of the negative pressure pump 50 is stopped in the state where the driving of the circulation pump 10 is continued, the atmosphere open valve 138 is opened and closed. The meniscus pressure P can be kept at an appropriate value by opening and closing the atmosphere open valve 138 in the state where the driving of the negative pressure pump 50 is stopped. It is thus possible to inhibit power consumption for driving the negative pressure pump 50.

According to the second embodiment, the controller 7 determines, based on the measurement values of the first pressure sensor 11 and the second pressure sensor 12, a time at which the atmosphere open valve 138 is opened and closed in the second period T2. It is thus possible to open and close the atmosphere open valve 138 at an appropriate timing, and to keep the meniscus pressure P at an appropriate value more reliably.

[Modifications]

The embodiment of the present disclosure is explained above. The present disclosure, however, is not limited to the above embodiment. Various changes or modifications may be made without departing from the claims.

For example, in the first embodiment, the controller 7 may make the number of rotations of the negative pressure motor 51 in the second period T2 lower than that in the first period T1. In this case, the third period T3 in which the negative pressure pump 50 is driven intermittently is not provided, and the number of rotations of the negative pressure motor 51 is reduced in the second period T2. This constantly drives the negative pressure pump 50 at a low duty. The meniscus pressure P is kept at an appropriate value by discharging gas in the subtank 3 by use of the negative pressure pump 50 and causing gas to flow into the subtank 3 through the atmosphere open channel 34. This reduces power consumption for driving the negative pressure pump 50 in the second period T2 after the first period T1, thus inhibiting power consumption for driving the negative pressure pump 50. Further, it is possible to inhibit deterioration in the negative pressure pump 50 which may otherwise be caused by repeatedly starting and stopping the driving of the negative pressure 50. This lengthens a lifetime of the apparatus.

In the first embodiment, after stopping the driving of the negative pressure pump 50 in the second period T2, the controller 7 may constantly drive the negative pressure pump 50 at a low duty by making the number of rotations of the negative pressure motor 51 in the third period T3 lower than that in the first period T1.

In the first embodiment, a second atmosphere open channel provided with a valve may be provided in addition to the atmosphere open channel 34. For example, when an ink discharge amount is large, the inflow of gas from the atmosphere open channel 34 alone cannot inhibit the decrease in the meniscus pressure P. Excessive negative pressure may thus be applied to the meniscuses. In this case, it is possible to inhibit excessive negative pressure from being applied to the meniscuses by opening the valve provided in the second atmosphere open channel to let in gas through the second atmosphere open channel.

In the first embodiment, the controller 7 rotates the circulation motor 16 when t=t'0 is satisfied (step S2), and rotates the negative pressure motor 51 when t=t0 is satisfied (step S3). However, the controller 7 may rotate the negative pressure motor 51 when t=t'0 is satisfied and may rotate the circulation motor 16 when t=t0 is satisfied. Further, the circulation motor 16 and the negative pressure motor 51 may be rotated in the same period (e.g., when t=t0 is satisfied). In any case, the number of rotations of the circulation motor 16 and the negative pressure motor 51 is controlled so that the value of the meniscus pressure is in the predefined range (+L to −LkPa).

In the first embodiment and the second embodiment, the meniscus pressure P is increased by allowing gas to flow into the subtank 3 through the atmosphere open channel 34 or 134. However, the meniscus pressure P may be increased by increasing the number of rotations of the circulation motor 16 to make the duty of the circulation pump 10 high. In this case, the duty of the circulation pump 10 varies after the time t1 in the first embodiment or the time t11 in the second embodiment.

In the first embodiment, the controller 7 restarts the driving of the negative pressure pump 50 when t=ta1 is satisfied in the third period T3, and stops the driving of the negative pressure pump 50 when the meniscus pressure P reaches −Ls. However, the controller 7 may restart the driving of the negative pressure pump 50 when t=ta1 is satisfied, and may stop the driving of the negative pressure pump 50 after predefined time has elapsed (when t=tb1 is satisfied). Further, the controller 7 may restart and stop the driving of the negative pressure pump 50 repeatedly per predefined time in the third period T3. In this case, the first pressure sensor 11 and the second pressure sensor 12 may not be arranged.

In the second embodiment, the controller 7 may open and close the atmosphere open valve 138 repeatedly per predefined time.

In the first embodiment and the second embodiment, any one of the first pressure sensor 11 and the second pressure sensor 12 may be provided.

In the first embodiment, the channel resistance of the atmosphere open channel 34 may be determined in advance depending on a discharge amount of ink required for printing an image on the sheet 100. For example, when a large amount of ink is required to be discharged to print an image, the number of rotations of the circulation motor 16 is increased to make the duty of the circulation pump 10 large. In this case, since positive pressure applied to the meniscus is large, the number of rotations of the negative pressure motor 51 is required to be increased to make the duty of the negative pressure pump 50 large. This reduces pressure in the subtank 3 compared to a case where the duty of the circulation pump 10 is small. When the atmosphere open channel 34 is opened in such a state, a large amount of gas flows from the atmosphere into the subtank 3 having low pressure. This greatly increases the meniscus pressure P (i.e., the meniscus pressure P reaches +Ls in a short time). In order to reduce the increased meniscus pressure P, it is necessary to restart the driving of the negative pressure pump 50 at short interval, which increases the number of times of intermittent driving of the negative pressure pump 50. This is not preferable from the viewpoint of reducing power consumption for driving the negative pressure pump 50. Thus, when a large amount of ink is required to be discharged to print an image, the channel resistance of the atmosphere open channel 34 is set to be large. This decreases a flowing amount of gas inflowing from the atmosphere open channel 34 as well as the number of times of intermittent driving of the negative pressure pump 50, thus reducing power consumption. When a small amount of ink is required to be discharged to print an image, the channel resistance of the atmosphere open channel 34 is set to be small.

In the above embodiment, when a larger amount of ink than an assumed ink discharge amount is discharged, the controller 7 may increase the number of rotations of the circulation motor 16 and the negative pressure motor 51 in the first period T1 (or T11) to decrease pressure in the subtank 3. In this configuration, even when a large amount of ink is discharged to greatly decrease the meniscus pressure P, the meniscus pressure P can be kept in the predefined range ($-L \leq P \leq +L$), because a large amount of gas flows from the atmosphere open channel 34 into the subtank 3 having low pressure.

In the above embodiment, the printer is a line head printer. However, the printer may be a serial printer having a carriage. In the serial printer, the ink-jet head 4 is carded on the carriage. Ink is discharged from the nozzles 40 during reciprocating movement of the ink-jet head 4 and the carriage in the sheet width direction. The sheet width direction is a scanning direction. In the serial printer, the nozzles 40 are arranged in the conveyance direction.

What is claimed is:

1. A liquid discharge apparatus, comprising:
a liquid discharge head having a nozzle;
a storage chamber configured to store liquid;
a supply channel communicating with the liquid discharge head and an outlet of the storage chamber;
a return channel communicating with the liquid discharge head and an inlet of the storage chamber;
a first pump provided in the supply channel and configured to feed the liquid stored in the storage chamber to the liquid discharge head;
a gas channel connected to the storage chamber;
a second pump connected to the storage chamber via the gas channel and configured to discharge gas from inside of the storage chamber; and
a controller,
wherein the controller is configured to:
continue driving of the first pump and driving of the second pump in a first period that starts in a case that the driving of the first pump and the driving of the second pump are started; and
stop the driving of the second pump with the driving of the first pump being continued, in a second period after the first period.

2. The liquid discharge apparatus according to claim 1, wherein the controller is configured to: start the driving of the second pump after completion of the second period; and continue the driving of the first pump and the driving of the second pump in a third period after the second period.

3. The liquid discharge apparatus according to claim 2,
wherein a pressure sensor is provided in at least one of the supply channel and the return channel, and
the controller is configured to determine a time at which the second period is completed and the driving of the second pump is started, based on a measurement value of the pressure sensor.

4. The liquid discharge apparatus according to claim 1,
wherein the controller is configured to start the driving of the second pump after completion of the second period and configured to drive the second pump intermittently in a third period after the second period, and
the period in which the driving of the first pump and the driving of the second pump are continued and the period in which the driving of the second pump is stopped with the driving of the first pump being continued are repeated.

5. The liquid discharge apparatus according to claim 4,
wherein a pressure sensor is provided in at least one of the supply channel and the return channel, and
the controller is configured to determine a time at which the driving of the second pump is started in the third period and a time at which the driving of the second pump is stopped in the third period, based on a measurement value of the pressure sensor.

6. The liquid discharge apparatus according to claim 1, further comprising an atmosphere open channel by which the storage chamber is opened to atmosphere.

7. The liquid discharge apparatus according to claim 6, wherein the atmosphere open channel is opened at all times.

8. The liquid discharge apparatus according to claim 6,
wherein a channel resistance of the atmosphere open channel is set such that a gas flowing amount inflowing from the atmosphere open channel per unit time is larger than a maximum liquid flowing amount discharged from the nozzle per unit time, and
the controller is configured to drive the second pump such that a gas flowing amount discharged from inside of the storage chamber by the second pump per unit time is larger than the gas flowing amount inflowing from the atmosphere open channel per unit time.

9. The liquid discharge apparatus according to claim 1, further comprising: an atmosphere open channel by which the storage chamber is opened to atmosphere; and a valve by which the atmosphere open channel is opened and closed,
wherein the controller is configured to:
close the valve in the first period; and
adjust pressure in the storage chamber by opening and closing the valve in the second period.

10. The liquid discharge apparatus according to claim 9,
wherein a pressure sensor is provided in at least one of the supply channel and the return channel, and
the controller is configured to determine a time at which the valve is opened and closed based on a measurement value of the pressure sensor.

11. The liquid discharge apparatus according to claim 1,
wherein the liquid discharge head includes a plurality of individual channels,
each of the individual channels include the nozzle,
the supply channel communicates with an inlet of each of the individual channels and the outlet of the storage chamber, and
the return channel communicates with an outlet of each of the individual channels and the inlet of the storage chamber.

12. A liquid discharge apparatus, comprising:
a liquid discharge head having a nozzle;
a storage chamber configured to store liquid;
a supply channel communicating with the liquid discharge head and an outlet of the storage chamber;
a return channel communicating with the liquid discharge head and an inlet of the storage chamber;
a first pump provided in the supply channel and configured to feed the liquid stored in the storage chamber to the liquid discharge head;
a gas channel connected to the storage chamber;
a second pump connected to the storage chamber via the gas channel and configured to discharge gas from inside of the storage chamber; and
a controller,
wherein the controller is configured to:

continue driving of the first pump and driving of the second pump in a first period that starts in a case that the driving of the first pump and the driving of the second pump are started; and in a second period after the first period, drive the second pump with the driving of the first pump being continued, such that an average power consumption of the second pump in the second period is lower than an average power consumption of the second pump in the first period.

13. The liquid discharge apparatus according to claim 12, further comprising a motor configured to drive the second pump, wherein the controller is configured to make the number of rotations of the motor in the second period lower than the number of rotations of the motor in the first period.

14. The liquid discharge apparatus according to claim 12, further comprising an atmosphere open channel by which the storage chamber is opened to atmosphere.

15. The liquid discharge apparatus according to claim 14, wherein the atmosphere open channel is opened at all times.

16. The liquid discharge apparatus according to claim 14, wherein a channel resistance of the atmosphere open channel is set such that a gas flowing amount inflowing from the atmosphere open channel per unit time is larger than a maximum liquid flowing amount discharged from the nozzle per unit time, and the controller is configured to drive the second pump such that a gas flowing amount discharged from inside of the storage chamber by the second pump per unit time is larger than the gas flowing amount inflowing from the atmosphere open channel per unit time.

17. The liquid discharge apparatus according to claim 12, wherein the liquid discharge head includes a plurality of individual channels, each of the individual channels includes the nozzle, the supply channel communicates with an inlet of each of the individual channels and the outlet of the storage chamber, and the return channel communicates with an outlet of each of the individual channels and the inlet of the storage chamber.

* * * * *